US008869907B2

(12) United States Patent
Guo et al.

(10) Patent No.: US 8,869,907 B2
(45) Date of Patent: Oct. 28, 2014

(54) HAND-HELD AEROSOL FIRE SUPPRESSION APPARATUS

(75) Inventors: Hongbao Guo, Xi'an (CN); Zhenping Deng, Xi'an (CN); Gaofeng Zheng, Xi'an (CN); Sanxue Zhang, Xi'an (CN); Xianfei Zhu, Xi'an (CN); Honghong Liu, Xi'an (CN); Weipeng Zhang, Xi'an (CN); Zanfeng Zhang, Xi'an (CN)

(73) Assignee: Shaanxi J & R Fire Fighting Co., Ltd., Xi'an (CN)

( * ) Notice: Subject to any disclaimer, the term of this patent is extended or adjusted under 35 U.S.C. 154(b) by 211 days.

(21) Appl. No.: 13/322,446

(22) PCT Filed: Jun. 6, 2010

(86) PCT No.: PCT/CN2010/073592

§ 371 (c)(1), (2), (4) Date: Nov. 23, 2011

(87) PCT Pub. No.: WO2010/142223

PCT Pub. Date: Dec. 16, 2010

(65) Prior Publication Data

US 2012/0073841 A1 Mar. 29, 2012

(30) Foreign Application Priority Data

Jun. 8, 2009 (CN) ..... 2009 2 0033448 U
May 26, 2010 (CN) ..... 2010 2 0203715 U

(51) Int. Cl.

| | |
|---|---|
| ***A62C 13/00*** | (2006.01) |
| ***A62C 35/02*** | (2006.01) |
| ***A62C 11/00*** | (2006.01) |
| ***A62C 13/62*** | (2006.01) |
| ***A62C 13/66*** | (2006.01) |
| ***A62C 35/58*** | (2006.01) |
| ***A62C 13/22*** | (2006.01) |

(52) U.S. Cl.

CPC ..... *A62C 13/006* (2013.01); *A62C 13/22* (2013.01)

USPC ..... 169/72; 169/28; 169/30; 169/35; 169/71; 169/77

(58) Field of Classification Search

USPC ..... 169/28, 72, 77, 84, 30, 35, 36, 71, 85, 169/88

See application file for complete search history.

(56) References Cited

U.S. PATENT DOCUMENTS 3,039,507 A * 6/1962 Hattan ..... 411/262
3,889,758 A * 6/1975 Dunn ..... 169/74

(Continued)

*Primary Examiner* — Len Tran
*Assistant Examiner* — Thomas Berez
(74) *Attorney, Agent, or Firm* — Studebaker & Brackett PC

(57) ABSTRACT

There is provided a hand-held aerosol fire suppression apparatus, having button, thermal insulating layer, jet nozzle, enclosure of apparatus, combustion chamber, rear fender and rear cap, wherein the enclosure of apparatus has an enclosure of cartridge that accommodate a chemical agent and an enclosure of cooling layer that is filled with a cooling material, the combustion chamber is installed between the enclosure of cartridge and the enclosure of cooling layer, the thermal insulating layer is arranged between the enclosure of apparatus and the enclosure of cartridge, between the enclosure of apparatus and the enclosure of cooling layer, and between the rear fender and the chemical agent. Compared to the prior art, the apparatus has the following advantages: compact in size, suitable for hand-held use, lower temperature at the jet orifice, safe and reliable ignition and operation and long service life.

6 Claims, 2 Drawing Sheets

(56) References Cited

U.S. PATENT DOCUMENTS 5,615,743 A * 4/1997 Matsumoto et al. ..... 169/74
5,842,525 A * 12/1998 Graham ..... 169/50
6,702,033 B1 * 3/2004 Mitchell et al. ..... 169/85
2007/0079972 A1 * 4/2007 Gross ..... 169/46
2007/0102167 A1 * 5/2007 Rousseau et al. ..... 169/77
2010/0139932 A1 * 6/2010 Guenthner et al. ..... 169/48

* cited by examiner

HAND-HELD AEROSOL FIRE SUPPRESSION APPARATUS

CROSS REFERENCE TO RELATED APPLICATIONS

This is a U.S. National Phase patent application of PCT/CN2010/073592, filed Jun. 6, 2010, which claims priority to Chinese Patent Application No. 200920033448.8, filed Jun. 8, 2009, and Chinese Patent Application No. 201020203715.4, filed May 26, 2010, each of which is hereby incorporated by reference in the present disclosure in its entirety.

FIELD OF THE INVENTION

The present invention belongs to the technical field of gas fire suppression, and relates to a hand-held aerosol fire suppression apparatus.

BACKGROUND OF THE INVENTION

In our working and living environments in modem times, fire hazard exists everywhere in limited spaces, such as machines, electrical devices, automobiles, electric cabinets, all kinds of household electric appliances, computers, TV sets, kitchens, etc., and spontaneous ignition of wires or engines often occurs due to extremely high temperature. Usually, using a hand-held fire suppression apparatus to quickly suppress such small-scale fire timely can get twice the result with half the effort.

In the prior art, the research on miniaturization of aerosol fire suppression apparatuses including the introduction of them into fire suppression applications in small spaces (e.g., household electrical appliances) has been made actively in foreign countries, and much progress has been achieved. For example, the products introduced by Firecom (Italy) mainly for kitchens don't have cooling and heat insulation parts. However, the fire extinguisher has the following major drawbacks: 1. The aerosol spurts out directly after the chemical agent is ignited, the temperature at the jet orifice is as high as 1200° C. or above, and the flame length is up to 100 mm, and therefore may cause scalding. 2. The handle doesn't have enough strength, and may deform when force is applied on it. In addition, the battery is not convenient to install, and there is no way to judge whether the battery has to be replaced or not after long-time use. Up to now, no hand-held aerosol fire suppression apparatus product is available in the domestic market.

SUMMARY OF THE INVENTION

In view of the present situation in the prior art, the object of the present invention is to provide a hand-held aerosol fire suppression apparatus, which has a lower temperature at the jet orifice, safe and reliable ignition and operation and long service life.

The technical solution of the present invention will be detailed as following:

A hand-held aerosol fire suppression apparatus, comprising a button, a thermal insulating layer, a jet nozzle, an enclosure of apparatus, a combustion chamber, a rear fender and a rear cap, wherein the enclosure of apparatus contains an enclosure of cartridge that accommodates a chemical agent and an enclosure of cooling layer that is filled with a cooling material, the combustion chamber is installed between the enclosure of cartridge and the enclosure of cooling layer, the thermal insulating layer is arranged between the enclosure of apparatus and the enclosure of cartridge, between the enclosure of apparatus and the enclosure of cooling layer, and between the rear fender and the chemical agent.

Furthermore, the apparatus comprises a safety pole and a safety ring, wherein the safety ring is a circular ring connected with a thin wire, and the other end of the thin wire is led into a small hole arranged above the piezoelectric ceramics.

Furthermore, the thermal insulating layer is made of aluminum silicate fibers or asbestos material.

Furthermore, a tapered jet orifice is arranged between the jet nozzle and the enclosure of cooling layer, and the tapered jet orifice has 30~40 mm inlet diameter and 5~12 mm outlet diameter.

Furthermore, the jet nozzle is screwed or fitted to the enclosure of apparatus, and the rear cap is screwed to the enclosure of apparatus.

Furthermore, the jet nozzle is screwed to the enclosure of apparatus and the thread structure that is used to screw the jet nozzle to the enclosure of apparatus is a segmented thread structure that comprises 3~6 thread segments.

Furthermore, a groove is arranged on the enclosure of apparatus to facilitate gripping.

Furthermore, the apparatus comprises piezoelectric ceramics and the two pins of the piezoelectric ceramics are connected to an ignition loop.

Furthermore, the hand-held aerosol fire suppression apparatus can be fixed in a U-shaped holder and a spongy cushion is provided on the U-shaped holder.

Furthermore, the U-shaped holder has a tray that can support the apparatus on the bottom, a retaining ring that can hold the apparatus on the upper part, and a fixing hole in the middle part.

Compared to that in the prior art, the apparatus in the present invention has the following advantages: 1. The cooling layer and thermal insulating layer in the apparatus can cool down the flames to protect the operator against scalding; 2. The safety ring and button on the apparatus can keep the apparatus in a safe state till the safety ring is pulled; 3. The apparatus doesn't rely on any battery for power supply; 4. The taper jet orifice and jet nozzle on the apparatus greatly increase the jet length and jet velocity, and thereby improve the fire suppression efficacy; 5. In case of any accident, the safety of the apparatus is improved greatly.

BRIEF DESCRIPTION OF THE DRAWINGS

The present invention will be detailed with reference to the drawings to make the above-mentioned advantages of the present invention be understood more clearly.

In the figures: 1—safety pole, 2—button, 3—thermal insulating layer, 4—enclosure of cartridge, 5—chemical agent, 6—enclosure of cooling layer, 7—cooling material, 8—jet nozzle, 9—tapered jet orifice, 10—enclosure of apparatus, 11—combustion chamber, 12—groove, 13—installing hole, 14—rear fender, 15—piezoelectric ceramics, 16—U-shaped holder, 17—rear cap, 18—safety ring, 19—spongy cushion,

20—fixing hole, 21—tray, 22—retaining ring, 30—thread-less segment, 31 thread segment.

DETAILED DESCRIPTION OF THE EMBODIMENTS

The embodiments of the present invention will be further detailed with reference to the drawings.

Figure 1:
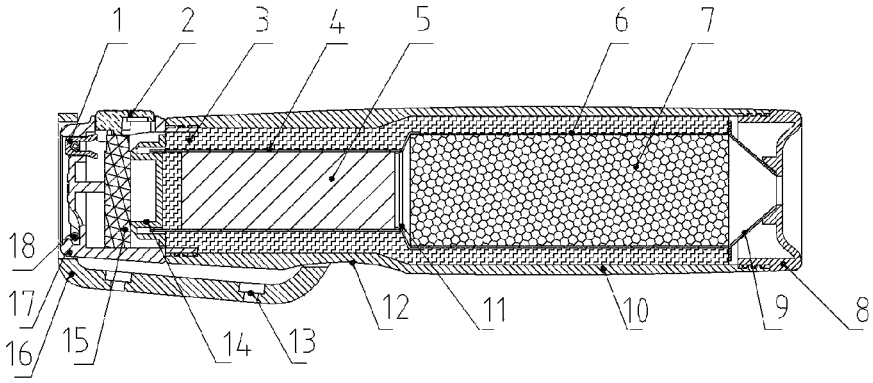
FIG. 1 is a schematic structural diagram of the hand-held aerosol fire suppression apparatus in the present invention.

FIG. 1 is a schematic structural diagram of the hand-held aerosol fire suppression apparatus in the present invention. As shown in FIG. 1, a cylindrical enclosure of cartridge 4 to accommodate a chemical agent 5 is arranged in the fire suppression apparatus, the chemical agent 5 in the enclosure of cartridge 4 is an aerosol generating agent, a combustion chamber 11 is connected at one end of the enclosure of cartridge 4. When the apparatus is in use, the aerosol generating agent can be ignited in the combustion chamber and produces aerosol. In view that the temperature of aerosol is very high, an enclosure of cooling layer 6 that is filled with a cooling material 7 is connected at one end of the combustion chamber, so that the aerosol produced in the combustion chamber can be cooled down by the cooling material.

In this example, an enclosure of apparatus 10 is arranged outside of the enclosure of cartridge 4 and the enclosure of cooling layer 6; moreover, a rear fender 14 is installed at the other end of the enclosure of cartridge 4. In addition, to facilitate hand-held fire suppression operation, a groove 12 is arranged on the enclosure of apparatus 10 to facilitate gripping.

Furthermore, the apparatus has safety pole 1, a safety ring 18, a button 2, and piezoelectric ceramics 15, wherein, the two pins of the piezoelectric ceramics 15 are connected to an ignition loop, the rear fender 14 is installed between the piezoelectric ceramics and the enclosure of cartridge, the safety ring 18 is a circular ring connected with a thin wire, and the other end of the thin wire is led into a small hole arranged above the piezoelectric ceramics 15. The above-mentioned apparatus has a safety protection function, i.e., the ignition loop connected with the piezoelectric ceramics 15 can be activated only when the safety ring 18 is pulled out and the button 2 is pressed down; in other words, the safety ring 18 and button 2 in the apparatus keep the apparatus in safe state till the safety ring is pulled.

A rear cap 17 and a jet nozzle 8 are arranged at the two ends of the enclosure of apparatus 10, wherein the rear cap 17 is screwed to the enclosure of apparatus 10, and is arranged at the rear end of the fire suppression apparatus. In addition, the jet nozzle 8 is screwed to the enclosure of apparatus 10. Of course, the connections on the apparatus can be in the form of a fitting connection or any other connection forms.

To increase the jet velocity and jet length of aerosol, a tapered jet orifice 9 is arranged in front of the jet nozzle 8; one end of the tapered jet orifice 9 is connected to the enclosure of cooling layer 6, and the other end is connected to the jet nozzle 8. That structure can greatly increase the jet length and jet velocity, and thereby improves the fire suppression efficacy. Usually, the tapered jet orifice 9 has a 30~40 mm inlet diameter and a 5~12 mm outlet diameter.

Figure 2:
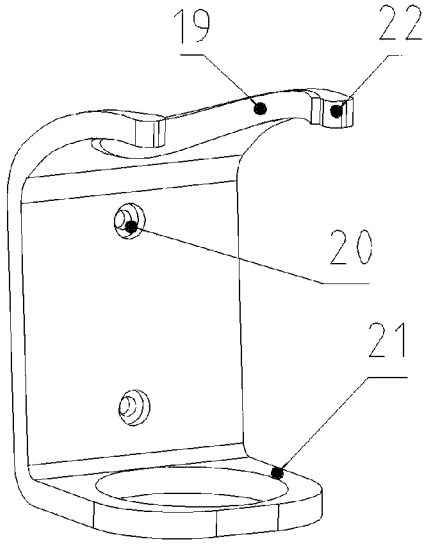
FIG. 2 is a three-dimensional structural diagram of the U-shaped holder for the hand-held aerosol fire suppression apparatus in the present invention.

FIG. 2 is a three-dimensional structural diagram of the U-shaped holder for the hand-held aerosol fire suppression apparatus in the present invention. As shown in FIG. 2, the hand-held aerosol fire suppression apparatus can be fixed in a U-shaped holder 16, and a spongy cushion 19 is provided on the U-shaped holder 16. The U-shaped holder 16 has a tray 21 that can support the apparatus on the bottom, a retaining ring 22 that can hold the apparatus on the upper part, and a fixing hole 20 in the middle part.

Figure 3:
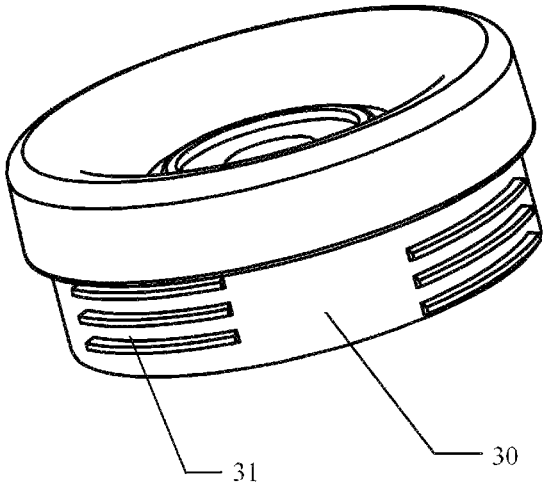
FIG. 3 is an enlarged view of the structure of the jet nozzle on the hand-held aerosol fire suppression apparatus in the present invention.

Now the present invention will be described with reference to FIG. 3, an enlarged view of the jet nozzle structure on the apparatus in the present invention. In order to enhance the safety of the apparatus in case of any accident, a thread structure is employed to screw the jet nozzle 8 to the enclosure of apparatus 10; in addition, the thread structure is in a segmented thread design, i.e., the jet nozzle 8 has thread segments 31 and thread-less segments 31 alternately arranged in alternate; moreover, in a preferred example, the thread structure for screwing the jet nozzle 8 to the enclosure of apparatus 10 comprises 3~6 thread segments. Of course, the segmented thread structure can be in other forms. With the segmented thread design for screwing the jet nozzle 8 to the enclosure of apparatus, the time required for removing the jet nozzle 8 can be reduced significantly. In case of any accident or the apparatus is jammed, the jet nozzle 8 can be removed easily, so that the heat generated in the aerosol generation process can be exhausted quickly from the apparatus.

In addition, to protect the operator against scalding, a thermal insulating layer 3 is arranged between the enclosure of apparatus 10 and the enclosure of cartridge 4, between the enclosure of apparatus 10 and the enclosure of cooling layer 6, and between the rear fender 14 and the chemical agent 5; the thermal insulating layer 3 is preferably made of aluminum silicate fiber or asbestos material; of course, other heat insulating materials can be selected for the thermal insulating layer 3.

Moreover, the cooling material in the present invention can be a cellular ceramics cooling material. To use the apparatus, the operator can pull out the safety ring 18 and press down the button 2; thus, the aerosol generating agent 5 is ignited to produce aerosol; the cellular ceramic cooling material cools the aerosol and eliminates flames; then, the jet velocity of aerosol is increased when the aerosol passes through the tapered jet orifice 9, so as to meet the requirement for the jet length. Cellular ceramic materials have intrinsic thermal storage and slag filtering features. An appropriate ceramic material can be selected to meet the demand for flame elimination and cooling. With the tapered jet orifice 9, the jet velocity of aerosol is increased, and thereby the jet length is increased effectively. With the heat insulating material 3 (aluminum silicate), the temperature of the walls of the apparatus will not be increased to a level that affects normal operation of the apparatus due to the heat released in the aerosol generation process.

Moreover, a chemical coolant can be selected as the cooling material in the present invention. To use the apparatus, the operator can pull out the safety ring 18 and press down the button 2; thus, the aerosol generating agent 5 is ignited to produce aerosol; the chemical coolant cools the aerosol and eliminates flames; then, the jet velocity of aerosol is increased when the aerosol passes through the tapered jet orifice 9, so as to meet the requirement for the jet length. The chemical coolant can meet the demand for flame elimination and cooling, and can improve the fire suppression efficacy to some extent. With the tapered jet orifice, the jet velocity of the aerosol is increased, and thereby the jet length is increased effectively. With the heat insulating material 3 (asbestos cloth), the temperature of the walls of the apparatus will not be increased to a level that affects normal operation of the apparatus due to the heat released in the aerosol generation process.

While the present invention is described as above in some examples, it should be understood that any change to the embodiments in style and details doesn't have influence on the essentials and protective scope of the present invention. On the basis of the above instruction for the present invention, those skilled in the art can easily make modifications or variations to the embodiments without departing from the spirit of the present invention; however, all these modifications or variations shall be deemed as falling into the protective scope of the present invention. Those skilled in the art shall appreciate that the above description is only provided to elaborate and explain the object of the present invention, instead of constituting any confinement to the present invention. The protective scope of the present invention shall only be confined by the claims and their equivalence.

The invention claimed is:

1. A hand-held aerosol fire suppression apparatus, comprising a button (2), a thermal insulating layer (3), a jet nozzle (8), an enclosure of apparatus (10), a combustion chamber (11), a rear fender (14) and a rear cap (17), wherein the enclosure of apparatus (10) contains an enclosure of cartridge (4) that accommodates a chemical agent (5) and an enclosure of cooling layer (6) that is filled with a cooling material (7), the combustion chamber (11) is installed between the enclosure of cartridge (4) and the enclosure of cooling layer (6), the thermal insulating layer (3) is arranged between the enclosure of apparatus (10) and the enclosure of cartridge (4), between the enclosure of apparatus (10) and the enclosure of cooling layer (6), and between the rear fender (14) and the chemical agent (5); a tapered jet orifice (9) is arranged between the jet nozzle (8) and the enclosure of cooling layer (6), and the tapered jet orifice (9) has a 30~40 mm inlet diameter and a 5~12 mm outlet diameter; the hand-held aerosol fire suppression apparatus can be fixed in a U-shaped holder (16) and a spongy cushion (19) is provided on the U-shaped holder (16); the U-shaped holder (16) has a tray that can support the apparatus on the bottom, a retaining ring (22) that can hold the apparatus on the upper part, and a fixing hold (20) in the middle part; the apparatus further comprises a safety pole (1) and a safety ring (18), wherein, the safety ring (18) is a circular ring connected with a thin wire, and the other end of the thin wire is led into a small hole arranged above piezoelectric ceramics (15).

2. The hand-held aerosol fire suppression apparatus according to claim 1, characterized in that:

the thermal insulating layer (3) is made of aluminum silicate fibers or asbestos material.

3. The hand-held aerosol fire suppression apparatus according to claim 1, characterized in that:

The jet nozzle (8) is screwed or fitted to the enclosure of apparatus (10) and the rear cap (17) is screwed to the enclosure of apparatus (10).

4. The hand-held aerosol fire suppression apparatus according to claim 1, characterized in that:

the jet nozzle (8) is screwed to the enclosure of apparatus (10), and a thread structure that is used to screw the jet nozzle (8) to the enclosure of apparatus (10) is a segmented thread structure that comprises 3~6 thread segments.

5. The hand-held aerosol fire suppression apparatus according to claim 1, characterized in that:

a groove (12) is arranged on the enclosure of apparatus (10) to facilitate gripping.

6. The hand-held aerosol fire suppression apparatus according to claim 1, characterized in that:

the piezoelectric ceramics (15) further comprise two pins connected to an ignition loop.

* * * * *